US010959031B2

(12) United States Patent
Christoph

(10) Patent No.: US 10,959,031 B2
(45) Date of Patent: Mar. 23, 2021

(54) LOUDSPEAKER ASSEMBLY

(71) Applicant: Harman Becker Automotive Systems GmbH, Karlsbad (DE)

(72) Inventor: Markus Christoph, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 329 days.

(21) Appl. No.: 16/068,074

(22) PCT Filed: Dec. 14, 2016

(86) PCT No.: PCT/EP2016/081011
§ 371 (c)(1),
(2) Date: Jul. 3, 2018

(87) PCT Pub. No.: WO2017/118550
PCT Pub. Date: Jul. 13, 2017

(65) Prior Publication Data

US 2020/0280813 A1 Sep. 3, 2020

(30) Foreign Application Priority Data

Jan. 4, 2016 (EP) ..... 16150042

(51) Int. Cl.
*H04S 7/00* (2006.01)
*H04R 1/02* (2006.01)
*H04R 1/40* (2006.01)

(52) U.S. Cl.
CPC ..... *H04S 7/30* (2013.01); *H04R 1/02* (2013.01); *H04R 1/403* (2013.01); *H04S 2400/01* (2013.01)

(58) Field of Classification Search
CPC ..... H04S 7/30; H04S 2400/01; H04R 3/12; H04R 1/02; H04R 1/403
See application file for complete search history.

(56) References Cited

U.S. PATENT DOCUMENTS 4,006,308 A 2/1977 Ponsgen
8,325,941 B2 12/2012 Hooley et al.
(Continued)

FOREIGN PATENT DOCUMENTS

CN 1402952 A 3/2003
CN 101953174 A 1/2011
CN 103069842 A 4/2013
WO 2006016156 A1 2/2006
(Continued)

OTHER PUBLICATIONS

Taraszka, "KEF Muon Floorstanding Loudspeaker Reviewed", http://hometheaterreview.com/kef-muon-floorstanding-loudspeaker-reviewed, Dec. 31, 2009, 3 pages.
(Continued)

*Primary Examiner* — David L Ton
(74) *Attorney, Agent, or Firm* — Brooks Kushman P.C.

(57) ABSTRACT

A loudspeaker assembly includes L loudspeakers, each being substantially the same size and having a peripheral front surface, and an enclosure having a hollow cylindrical body and end closures, the cylindrical body and end closures being made of material that is impervious to air. The cylindrical body comprises L openings therein. The L openings are sized and shaped to correspond with the peripheral front surfaces of the L loudspeakers, and have central axes. The central axes of the L openings are contained in a radial plane, and the angles between adjacent axes are identical. The L loudspeakers are disposed in the L openings and hermetically secured to the cylindrical body. L is equal to or greater than 2. A higher-order loudspeaker system comprising such a loudspeaker assembly and a beamforming module.

15 Claims, 7 Drawing Sheets

(56) References Cited

U.S. PATENT DOCUMENTS

| | | | | |
|---|---|---|---|---|
| 8,780,673 | B2 | 7/2014 | Cohen et al. | |
| 2007/0269071 | A1* | 11/2007 | Hooley | H04R 3/12 381/336 |
| 2008/0085027 | A1 | 4/2008 | Engebretson et al. | |
| 2017/0195815 | A1* | 7/2017 | Christoph | H04S 7/303 |

FOREIGN PATENT DOCUMENTS

| | | | |
|---|---|---|---|
| WO | 2007044209 | A2 | 4/2007 |
| WO | 2017025151 | A1 | 2/2017 |

OTHER PUBLICATIONS

Horbach et al., "Application of Linear-Phase Digital Crossover Filters to Pair-Wise Symmetric Multi-Way Loudspeakers Part 1: Control of Off-Axis Frequency Response", AES 32nd International Conference, Hillerod, Denmark, Sep. 21-23, 2007, 8 pages.

Horbach et al., "Application of Linear-Phase Digital Crossover Filters to Pair-Wise Symmetric Multi-Way Loudspeakers Part 2: Control of Beamwidth and Polar Shape", AES 32nd International Conference, Hillerod, Denmark, Sep. 21-23, 2007, 15 pages.

Office Action dated Dec. 2, 2019 for European Application No. 16809423.3 filed Jun. 26, 2018, 5 pgs.

Office Action dated Jul. 1, 2019 for Chinese Application No. 201680077371.7 filed Jun. 29, 2018, 7 pgs.

Office Action dated Mar. 11, 2020 for Chinese Application No. 201680077371.7 filed Jun. 29, 2018, 4 pgs.

Office Action dated Jun. 30, 2020 for Chinese Application No. 201680077371.7 filed Jun. 29, 2018, 4 pgs.

* cited by examiner

LOUDSPEAKER ASSEMBLY

CROSS-REFERENCE TO RELATED APPLICATION

This application is the U.S. national phase of PCT Application No. PCT/EP16/081011 filed on Dec. 14, 2016, which claims priority to EP Patent Application No. 16150042.6 filed on Jan. 4, 2016, the disclosures of which are incorporated in their entirety by reference herein.

TECHNICAL FIELD

The disclosure relates to loudspeaker assemblies, to loudspeaker systems including such loudspeaker assemblies, and to beamforming modules.

BACKGROUND

Sound reproduction systems aim to reproduce an arbitrary desired sound field within a region of space. The desired sound field may be generated using the Kirchhoff-Helmholtz integral, or cylindrical or spherical harmonic decompositions (higher order Ambisonics). The accuracy of sound reproduction is governed by the wavelength and the size of the region over which reproduction is required. Hence, large numbers of loudspeakers are required for the reproduction of high frequencies over significant areas. For example, reproduction over 0.1 m radius at 16 kHz requires 60 loudspeakers. In the three-dimensional case the required number of loudspeakers is significantly higher. A further limitation of reproduction in rooms is that commonly the loudspeakers produce an undesired reverberant field which corrupts the desired sound field within the array. This reverberant field can partly be cancelled using calibration and pre-processing but such techniques require accurate measurement of acoustic transfer functions and significant computing power. If, however, loudspeakers with omnidirectional and radial dipole directivity characteristics (responses) are used, it is possible to produce a first order directional sound field within the loudspeaker array and hence less disturbing exterior field results. Furthermore, higher order variable polar responses may produce further improvements in sound reproduction, since with higher orders, i.e. even more directive loudspeaker arrays, an even lower degree of unintended exterior sound field will be created during the course of establishing the desired wave field within the array. Thus, loudspeakers or loudspeaker assemblies with highly directive characteristics, such as those made available by combining an omnidirectional directivity characteristic and a radial dipole directivity characteristic to form first order directivity characteristics or higher order variable polar responses (higher-order loudspeakers) are highly appreciated.

SUMMARY

A loudspeaker assembly includes L loudspeakers, each being substantially the same size and having a peripheral front surface, and an enclosure having a hollow cylindrical body and end closures, the cylindrical body and end closures being made of material that is impervious to air. The cylindrical body comprises L openings therein. The L openings are sized and shaped to correspond with the peripheral front surfaces of the L loudspeakers, and have central axes. The central axes of the L openings are contained in a radial plane, and the angles between adjacent axes are identical. The L loudspeakers are disposed in the L openings and hermetically secured to the cylindrical body. L is equal to or greater than 2.

A higher-order loudspeaker system comprising a loudspeaker assembly and a beamforming module, wherein the loudspeaker assembly includes L loudspeakers, each being substantially the same size and having a peripheral front surface, and an enclosure having a hollow cylindrical body and end closures, the cylindrical body and end closures being made of material that is impervious to air. The cylindrical body comprises L openings therein. The L openings are sized and shaped to correspond with the peripheral front surfaces of the L loudspeakers, and have central axes. The central axes of the L openings are contained in a radial plane, and the angles between adjacent axes are identical. The L loudspeakers are disposed in the L openings and hermetically secured to the cylindrical body L is equal to or greater than 2.

Other assemblies, loudspeaker systems, features and advantages will be, or will become, apparent to one skilled in the art upon examination of the following figures and detailed description. It is intended that all such additional features and advantages be included within this description, be within the scope of the invention, and be protected by the following claims.

BRIEF DESCRIPTION OF THE DRAWINGS

The assemblies and systems may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION

Figure 1:
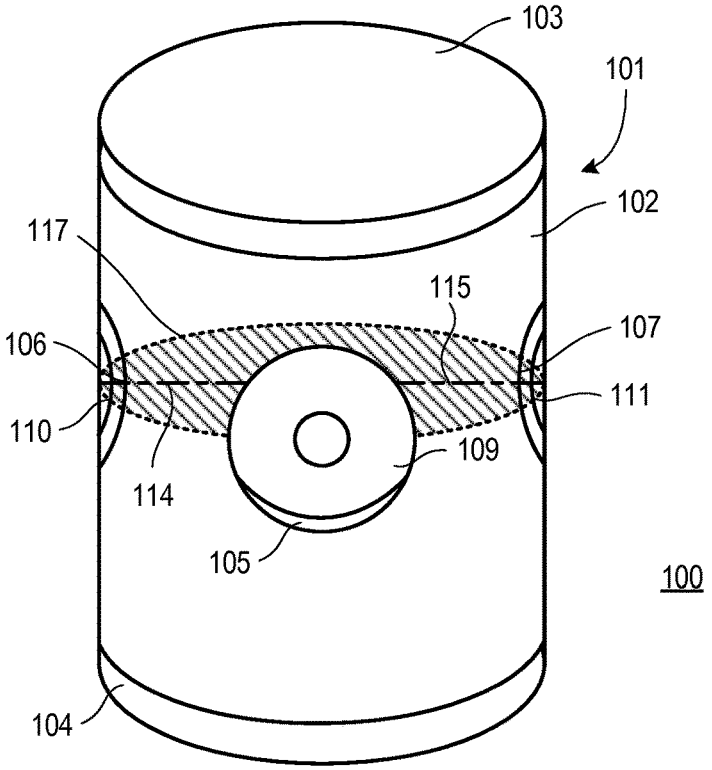
FIG. 1 is a three-dimensional side view of an exemplary loudspeaker assembly with one circumferential row of loudspeakers.
Figure 2:
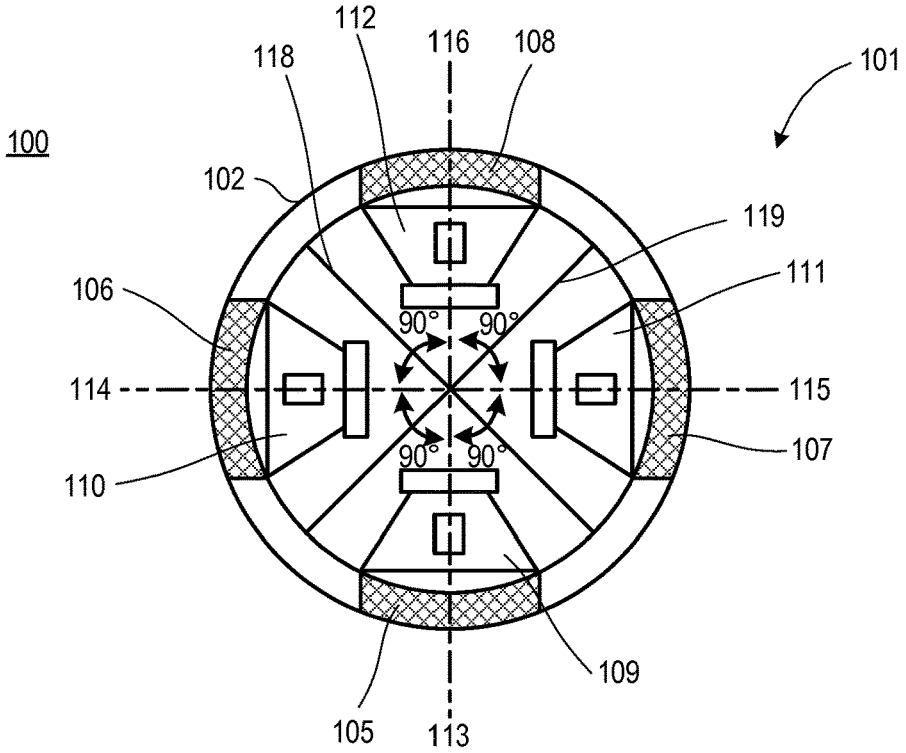
FIG. 2 is a sectional top view of the loudspeaker assembly shown in FIG. 1.

Referring to FIGS. 1 and 2 of the drawings, a loudspeaker assembly 100 is shown including a housing 101 having a hollow cylindrical body 102, top end closure 103 and bottom end closure 104. The cylindrical body 102 and end closures 103, 104 are made of material that is impervious to air. The housing 101 is provided with e.g., four circumferentially spaced openings 105 to 108, one for each of the four loudspeakers 109 to 112, which, in the example shown, have circular peripheral outlines but may have other shapes if appropriate. The four openings 105 to 108 are sized and shaped to correspond with the peripheral front surfaces of the four loudspeakers 109 to 112. The four openings 105 to 108 each have a central axis 113 to 116 contained in a radial plane 117. The four loudspeakers 109 to 112 are each substantially the same size and have a peripheral front surface which is also circular. The angles between adjacent axes 113 to 116 are identical, i.e., for four loudspeakers in a plane the identical angles are 360°/4=90° (90 degree). The hollow interior of the housing 101 may be filled or lined with sound deadening or damping material (not shown).

The four loudspeakers 109 to 112 are disposed in the four openings 105 to 108, and are hermetically secured to the cylindrical body 102. For example, each loudspeaker 109 to 112 may be secured to the cylindrical body 102 by bolts. The bolts may have countersunk, flat heads and may pass through holes disposed about the opening periphery and extend through holes in a loudspeaker mounting flange (not shown). When the bolts are tight, a gasket may be securely clamped between the loudspeaker peripheral front surface and the cylindrical inner surface of the cylindrical body 102. The end closures 103, 104 are secured to the cylindrical body 102 by any suitable means such as adhesive or screws or nails.

In the exemplary loudspeaker assembly 100 shown in FIGS. 1 and 2, the material for the cylindrical body 13 may be a tube made from wood, plastics, fiberboard, etc., that may be 0.5 cm to 2.5 cm thick with a diameter of 60 cm to 150 cm (e.g., 110 cm) and a length of (e.g., 130 cm). The end closures 103, 104 may be of wood, plastics, fiberboard, etc., that is 0.5 cm to 2.5 cm thick. The four loudspeakers 109 to 112 may have a 20 cm to 50 cm size, and may be broadband loudspeakers or mid-frequency range loudspeaker. It has been found that by making the housing cylindrical, it is possible to have an effectively closed baffle arrangement with requisite structural rigidity but without requiring use of heavy and massive materials. Optionally, walls 118 and 119 may disposed in the interior of the tube to provide a separate acoustic volume for some or each individual loudspeaker.

Figure 3:
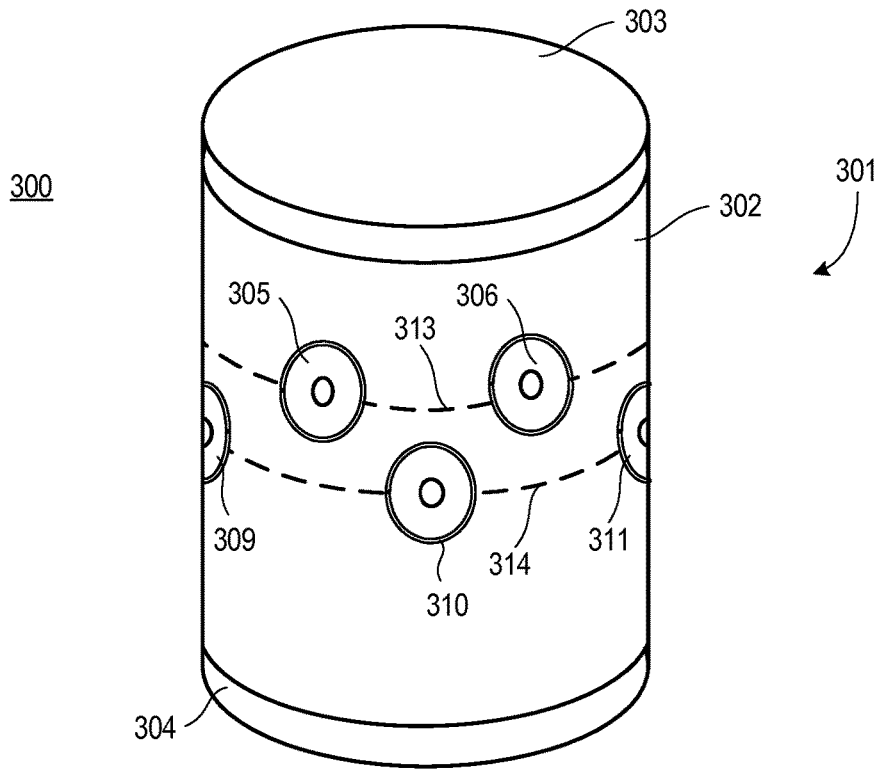
FIG. 3 is a three-dimensional side view of an exemplary loudspeaker assembly with two circumferential rows of loudspeakers.
Figure 4:
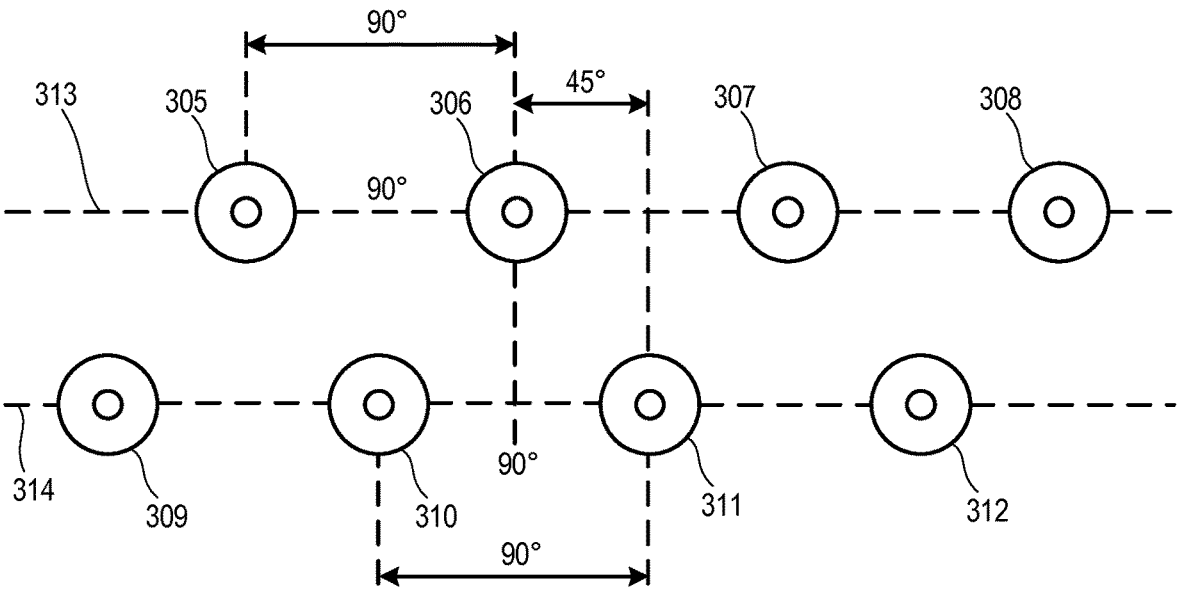
FIG. 4 is a linear depiction of the spatial relation between loudspeakers in the two rows of the loudspeaker assembly shown in FIG. 3.

In an exemplary loudspeaker assembly 300 shown in FIGS. 3 and 4, again four loudspeakers may be used but any other number greater than one would be applicable. The loudspeaker assembly 300 includes a housing 301 having a hollow cylindrical body 302, top end closures 303 and bottom end closure 304. The housing 301 is provided with four circumferentially spaced openings with central axes, one for each of the four loudspeakers 305 to 308. The housing 301 may be provided with further four circumferentially spaced openings with central axes, one for each of four additional loudspeakers 309 to 312, each being substantially the same size as the four loudspeakers 305 to 308. The central axes that correspond to loudspeakers 305 to 308 are contained in a radial plane 313. The central axes that correspond to loudspeakers 309 to 312 are contained in e.g. one additional radial plane 314. The angles between adjacent axes in radial planes 313 and 314 are identical, which is in this example 90°. The angles between adjacent axes in radial plane 314 are shifted from the angles between adjacent axes in radial plane 313 by an offset angle, which is here 90°/2=45°. FIG. 4 illustrates the spatial relation between loudspeakers 305 to 308 and 309 to 312 in a linear depiction.

Figure 5:
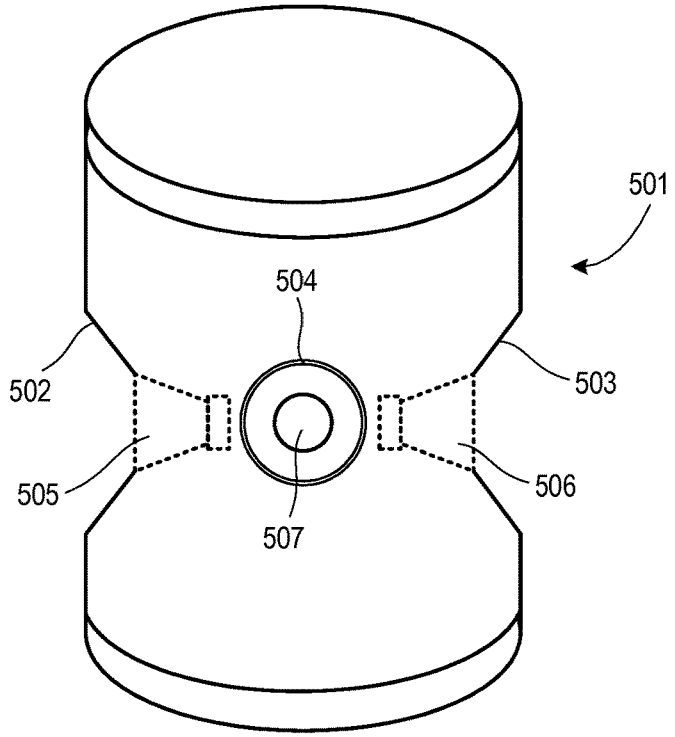
FIG. 5 is a three-dimensional side view of an exemplary loudspeaker assembly with dents.
Figure 6:
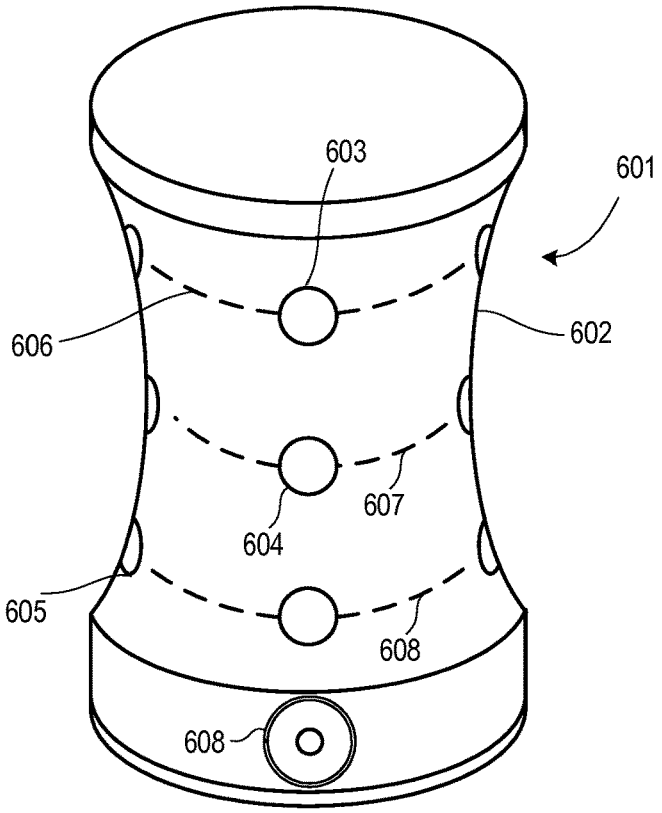
FIG. 6 is a three-dimensional side view of an exemplary loudspeaker assembly with a necking.

Referring to FIG. 5, a cylindrical body 501 (e.g., which may be similar to bodies 101, 301 and may be terminated by end closures) may comprise dents 502, 503, 504 in which loudspeakers 505, 506, 507 such as, e.g., loudspeakers 109-112, 305-308, 309-312 described above in connection with FIGS. 1 to 4 may be disposed, e.g., in the bottom of the dents. As illustrated in FIG. 6, alternatively or additionally, a cylindrical body 601 (e.g., which may be similar to bodies 101, 301, 501 and may be terminated by end closures) may comprise a necking 602 along its longitudinal direction in which loudspeakers 603, 604, 605 may be disposed in openings with radial axes in one or more radial planes 606, 607, 608. The loudspeakers 603, 604, 605 may be identical, similar or different and/or may be operated in identical, similar or different frequency ranges.

In order to limit undesired vertical reflections from the ceiling or the floor, the directivity of the loudspeaker assemblies can be further increased so that ideally only a controlled directivity in the horizontal plane would remain. As described above, a pure mechanical low-pass filter, implemented, e.g., by placing the loudspeakers in one, some or all planes at the base point of a dent, may be used to achieve such a desired, increased directivity in the vertical plane. Alternatively or additionally, some or all loudspeakers may be placed in one necking (contraction) of the cylindrical body of sufficiently large size to fit some or all loudspeakers, giving the cylindrical body the form of a bar-bell or inverse barrel. A combination of those two measures can be used as well, e.g., using a barbell shaped body with dents in which the loudspeakers are placed at its bases (not shown). In case of multiple planes, different radial planes may be filled with different loudspeaker types. For example, high-frequency range loudspeakers such as tweeters may be disposed in the middle of the necking (e.g., loudspeakers 604), mid-range loudspeakers may be placed (symmetrically) at a radial plane above and/or under the radial plane of the tweeters (e.g., loudspeakers 605 and 606) and, as the case may be, low-frequency loudspeakers, e.g. bass loudspeakers or woofers, may be arranged above and/or beneath the lower mid-frequency range loudspeakers (e.g., loudspeaker 609).

In order to further limit undesired vertical reflections from the ceiling or the floor, the directivity of the loudspeaker assemblies can be further increased so that ideally only a controlled directivity in the horizontal plane would remain. This may be achieved by connecting a (modal) beamforming module upstream of the loudspeakers that allows for increased vertical directivity (when the longitudinal axis of the cylindrical body is disposed in vertical direction), and thus for avoiding an undesired generation of reflections from the ceiling or floor.

Figure 7:
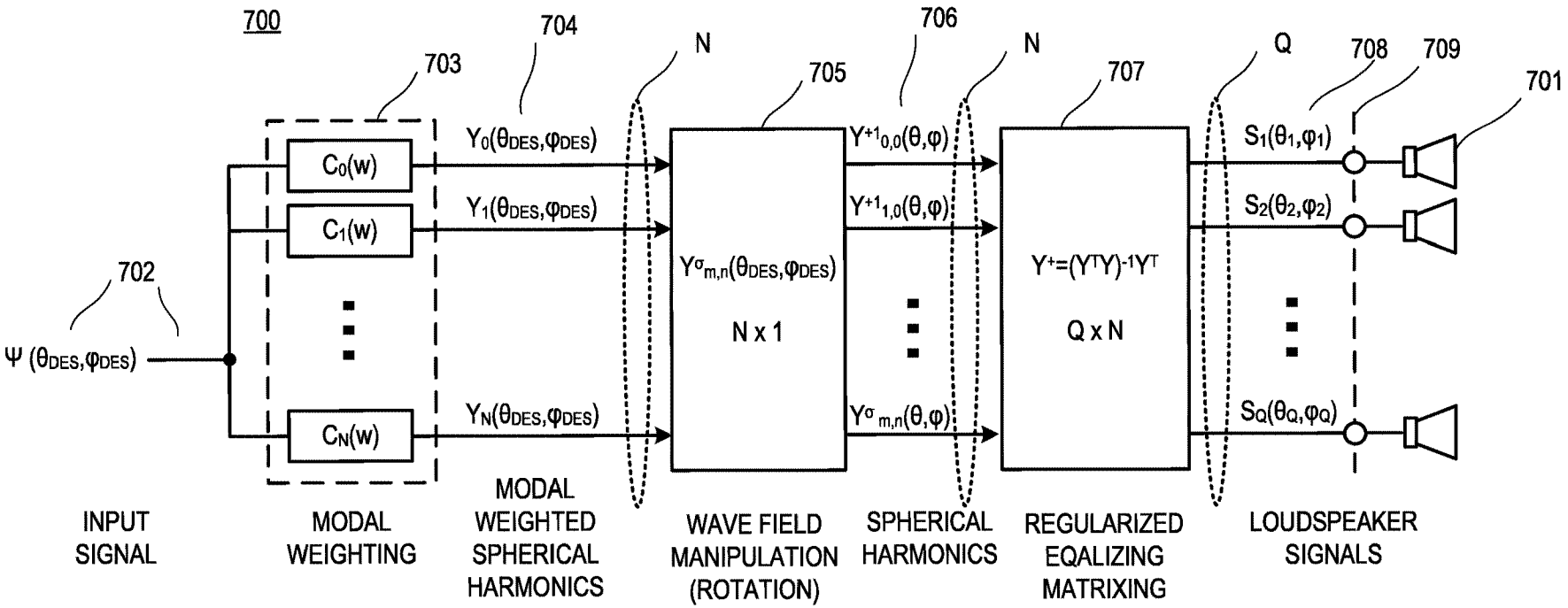
FIG. 7 is a signal flow chart illustrating an exemplary modal beamformer employing a weighting matrix for matrixing.

An exemplary modal beamforming module 700 is depicted in FIG. 7. The beamforming module 700 controls a loudspeaker assembly with Q loudspeakers 701 (or Q groups of loudspeakers each with a multiplicity of loudspeakers such as tweeters, mid-frequency range loudspeakers and/or woofers) dependent on N (Ambisonics) input signals 702, also referred to as input signals x(n) or Ambisonic signals, wherein N is for two dimensions $N_{2D}=(2M+1)$ and for three dimensions $N_{3D}=(M+1)^2$, wherein M represents the order and N the number of the spherical harmonics. The beamforming module 700 may further include a modal weighting sub-module 703, a dynamic wave-field manipulation sub-module 705, and a regularization and matrixing sub-module, referred to as regularized equalizing matrixing sub-module 707. The modal weighting sub-module 703 is supplied with the N input signal 702 which is weighted with modal weighting coefficients, i.e., filter coefficients $C_0(\omega)$, $C_1(\omega) \ldots C_N(\omega)$ in the modal weighting sub-module 703 to provide a desired beam pattern, i.e., radiation pattern, based on the N spherical harmonics to deliver N weighted Ambisonic signals 704. The weighted Ambisonic signals 704 are transformed by the dynamic wave-field manipulation sub-module 705 using N×1 weighting coefficients, e.g. to rotate the desired beam pattern to a desired position $\theta_{Des}, \varphi_{Des}$. Thus N modified (e.g., rotated, focused and/or zoomed) and weighted Ambisonic signals 706 are output by the dynamic wave-field manipulation sub-module 705. The N modified and weighted Ambisonic signals 706 are then input for regularization and matrixing into sub-module 707 which includes a radial equalizing filter for considering the susceptibility of the playback device with Higher-Order-Loudspeaker (HOL) preventing e.g. a given White-Noise-Gain (WNG) threshold from being undercut. In regularized equalizing matrixing sub-module 707, outputs of the regularization are transformed, e.g. by pseudo-inverse $Y^+=(Y^TY)^-Y^T$, which simplifies to $$Y^+ = \frac{1}{Q} Y^T,$$

if the Q lower-order loudspeakers are arranged at the body of the higher-order loudspeakers in a regular fashion, into the modal domain and subsequently into Q loudspeaker signals 708 by way of matrixing with a Q×N weighting matrix as shown in FIG. 7. The loudspeaker signals 708 are transmitted to the loudspeakers 701 via an electrical port 709. Alternatively, the Q loudspeaker signals 708 may be generated from the N regularized, modified and weighted Ambisonic signals 706 by way of a multiple-input multiple-output sub-module 801 using a Q×N filter matrix as shown in FIG. 8.

Figure 8:
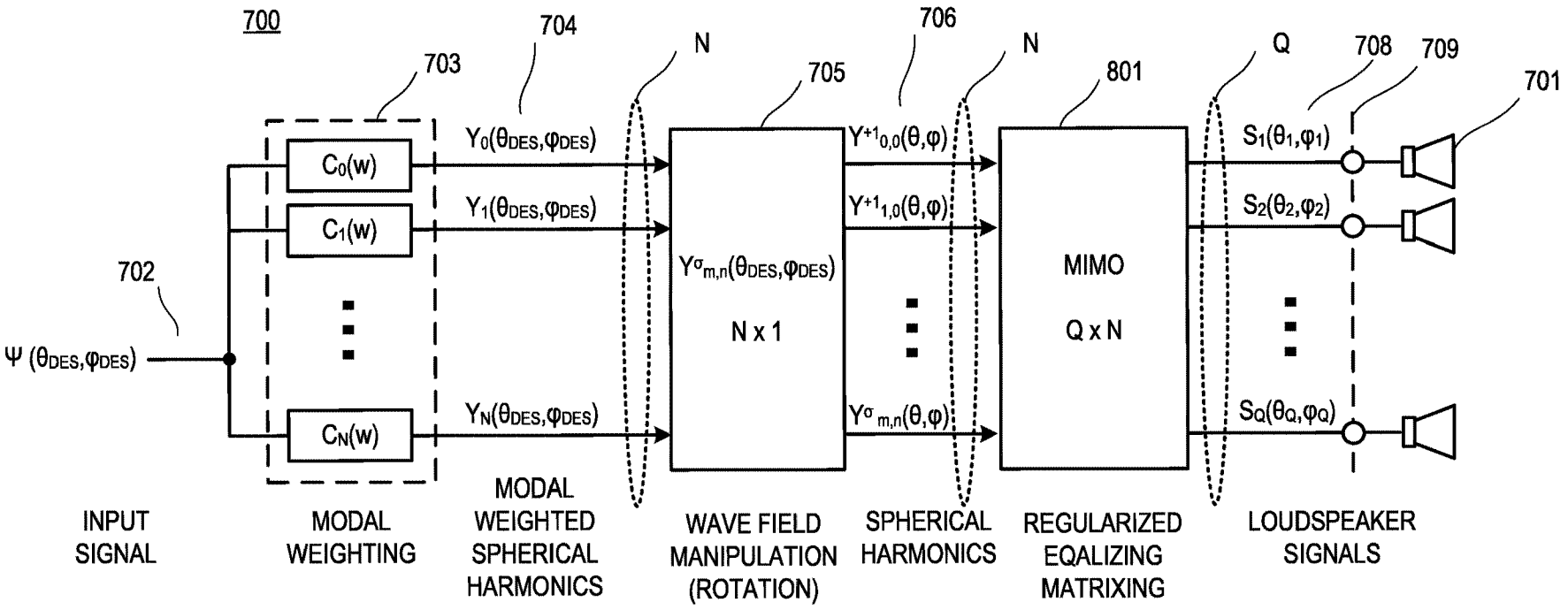
FIG. 8 is a signal flow chart illustrating an exemplary modal beamformer employing a multiple-input multiple-output module for matrixing.

The systems shown in FIGS. 7 and 8 may realize two-dimensional or three-dimensional audio using a sound field description by a technique called Higher-Order Ambisonics. Ambisonics is a full-sphere surround sound technique which may cover, in addition to the horizontal plane, sound sources above and below the listener. Unlike other multichannel surround formats, its transmission channels do not carry loudspeaker signals. Instead, they contain a loudspeaker-independent representation of a sound field, which is then decoded to the listener's loudspeaker setup. This extra step allows a music producer to think in terms of source directions rather than loudspeaker positions, and offers the listener a considerable degree of flexibility as to the layout and number of loudspeakers used for playback. Ambisonics can be understood as a three-dimensional extension of mid/side (M/S) stereo, adding additional difference channels for height and depth. In terms of First-Order Ambisonics, the resulting signal set is called B-format. The spatial resolution of First-Order Ambisonics is quite low. In practice, that translates to slightly blurry sources, but also to a comparably small usable listening area or sweet area.

The resolution can be increased and the sweet spot enlarged by adding groups of more selective directional components to the B-format. In terms of Second-Order Ambisonics these no longer correspond to conventional microphone polar patterns, but may look like, e.g., clover leaves. The resulting signal set is then called Second-, Third-, or collectively, Higher-Order Ambisonics (HOA). However, common applications of the HOA technique require, dependent on whether a two-dimensional (2D) and three-dimensional (3D) wave field is processed, specific spatial configurations notwithstanding whether the wave field is measured (decoded) or reproduced (coded): Processing of 2D wave fields requires cylindrical configurations and processing of 3D wave fields requires spherical configurations, each with a regular distribution of the microphones or loudspeakers.

An example of a simple Ambisonic panner (or encoder) takes an input signal, e.g., a source signal s and two parameters, the horizontal angle θ and the elevation angle φ. It positions the source at the desired angle by distributing the signal over the Ambisonic components with different gains for the corresponding Ambisonic signals W, X, Y and Z:

$$w = s \cdot \frac{1}{\sqrt{2}},$$

$$x = s \cdot \cos\theta \cdot \cos\varphi,$$

$$y = s \cdot \sin\theta \cdot \cos\varphi, \text{ and}$$

$$z = s \cdot \sin\varphi.$$

Being omnidirectional, the W channel always delivers the same signal, regardless of the listening angle. In order that it have more-or-less the same average energy as the other channels, W is attenuated by w, i.e., by about 3 dB (precisely, divided by the square root of two). The terms for X, Y, Z may produce the polar patterns of figure-of-eight. Taking their desired weighting values at angles θ and φ(x,y,z), and multiplying the result with the corresponding Ambisonic signals (X, Y, Z), the output sums lead to a figure-of-eight radiation pattern pointing now to the desired direction, given by the azimuth θ and elevation φ, utilized in the calculation of the weighting values x, y and z, having an energy content coping with the W component, weighted by w. The B-format components can be combined to derive virtual radiation patterns coping with any first-order polar pattern (omnidirectional, cardioid, hypercardioid, figure-of-eight or anything in between) pointing in any three-dimensional direction. Several such beam patterns with different parameters can be derived at the same time to create coincident stereo pairs or surround arrays.

Figure 9:
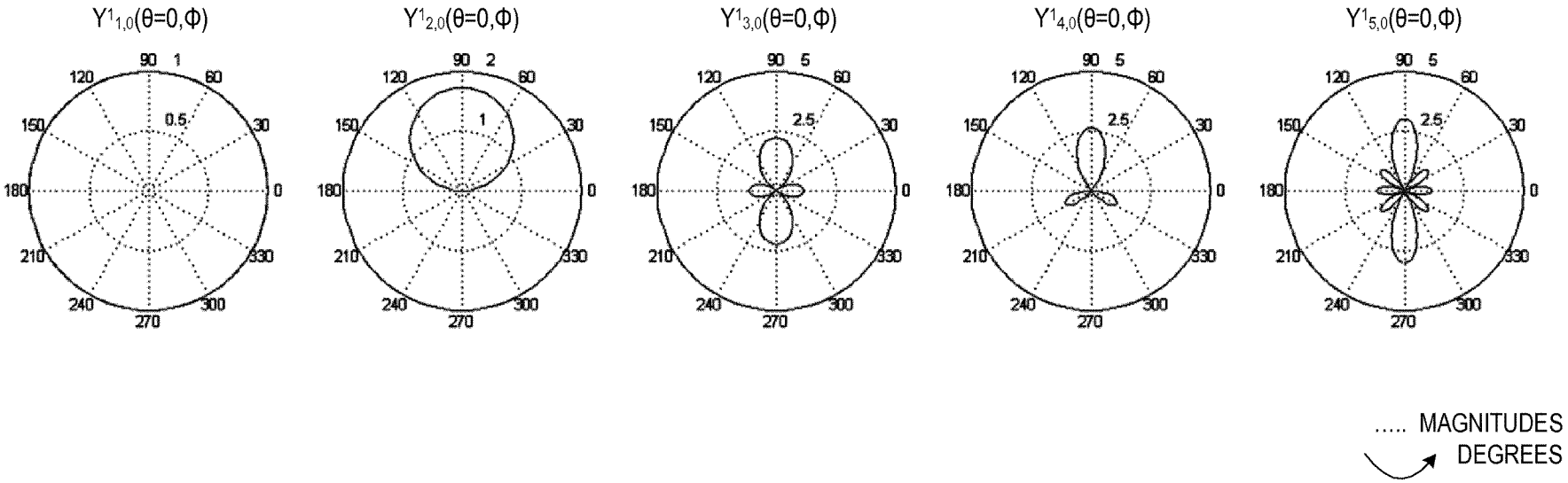
FIG. 9 is a two-dimensional depiction of the real parts of the spherical harmonics up to an order of M=4 in Z direction.

Referring now to FIG. 9, with higher-order loudspeaker systems including loudspeaker assemblies such as those described above in connection with FIGS. 1 to 6 and beamformer modules such as those shown in FIGS. 7 and 8, any desired directivity characteristic can be approximated by superimposing the basic functions, i.e., the spherical harmonics. FIG. 9 is a two-dimensional depiction (magnitudes vs. degrees) of the real spherical harmonics with orders of M=0 to 4 in the Z direction of the exemplary higher-order loudspeaker described above.

Figure 10:
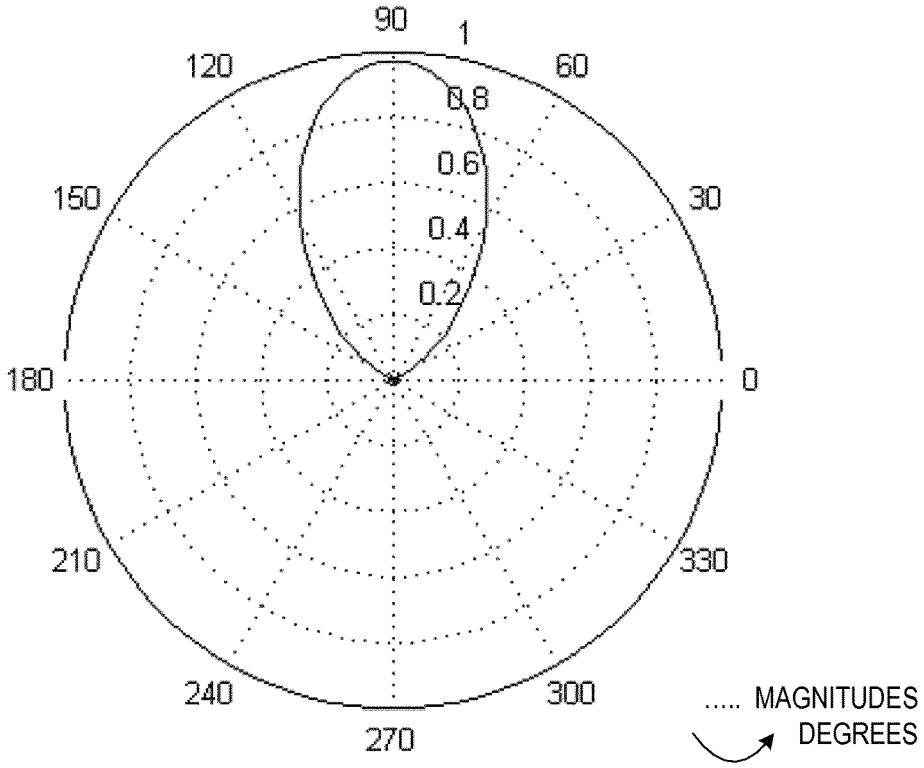
FIG. 10 is a diagram illustrating the directivity characteristic of a cardioid radiation pattern of 9th order.
Figure 11:
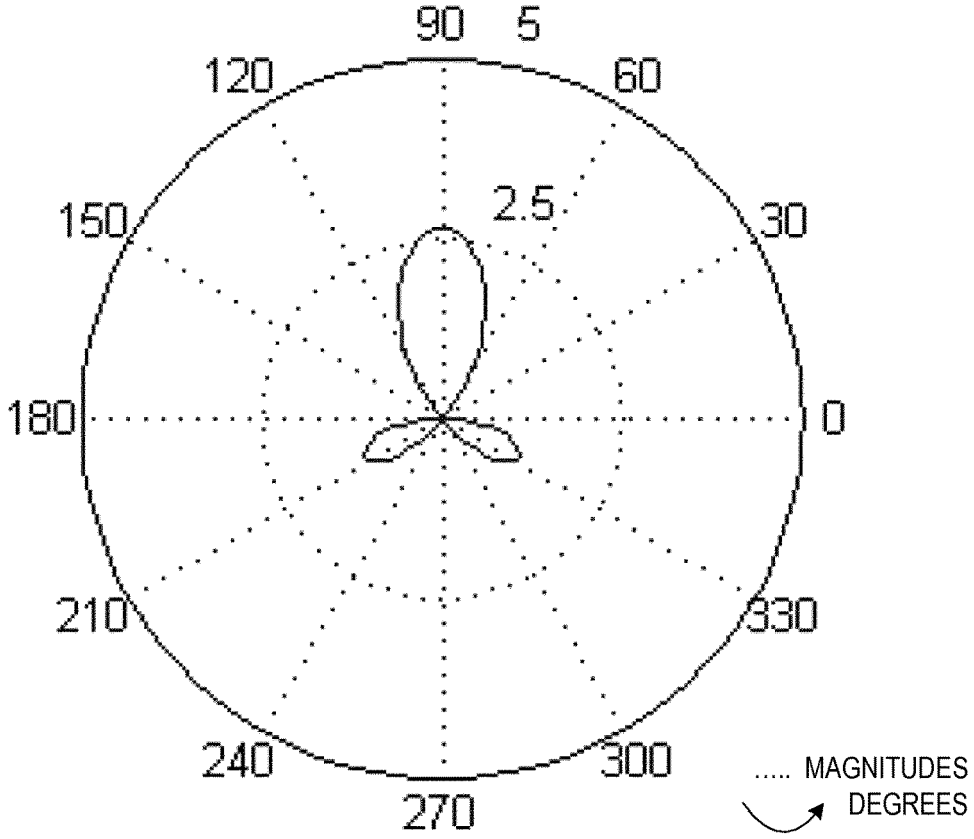
FIG. 11 is a diagram illustrating the directivity characteristic of the real part of the spherical harmonic of third order.

For example, when superimposing the five basic functions depicted in FIG. 9 using modal weighting coefficients $C_m$=[0.100, 0.144, 0.123, 0.086, 0.040], wherein m=[0 . . . 4], a directivity characteristic of an approximated cardioid of 9th order can be generated as shown in FIG. 10. Whereas when superimposing the five basic functions depicted in FIG. 9 using modal weighting coefficients $C_m$=[0.000, 0.000, 0.000, 1.000, 0.040], wherein again m=[0 . . . 4], a directivity characteristic of the real part of the spherical harmonic of third order in Z direction can be generated as shown in FIG. 10.

The description of embodiments has been presented for purposes of illustration and description. Suitable modifications and variations to the embodiments may be performed in light of the above description. The described assemblies and systems are exemplary in nature, and may include additional elements and/or omit elements. As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. A signal flow chart may describe a system, method or software executed by a processor and to the method dependent on the type of realization. e.g., as hardware, software or a combination thereof.

The invention claimed is:

1. A loudspeaker assembly comprising:

a plurality of loudspeakers, each loudspeaker being substantially the same size and having a peripheral front surface; and an enclosure having a hollow cylindrical body and end closures, the cylindrical body and end closures being made of material that is impervious to air; wherein the cylindrical body comprises a plurality of openings therein;

each opening has a central axis and is shaped to correspond with the peripheral front surface of the loudspeaker, the central axes of the plurality of openings are contained in a radial plane, and angles positioned between adjacent axes are identical; and each loudspeaker is disposed in the corresponding opening and is hermetically secured to the cylindrical body, the loudspeaker assembly further comprising:

a plurality of first additional loudspeakers, each first additional loudspeaker is substantially the same size as the loudspeaker of the plurality of loudspeakers and has a peripheral front surface; and a plurality of first additional openings provided in the cylindrical body; wherein each first additional opening has a central axis and is sized and shaped to correspond with the peripheral front surface of the first additional loudspeaker;

the central axes of the plurality of first additional openings are contained in a first additional radial plane, and angles between adjacent axes are identical; and the plurality of first additional loudspeakers is disposed in the plurality of first additional openings and is hermetically secured to the cylindrical body;

a plurality of second additional loudspeakers, each second additional loudspeaker having a peripheral front surface; and a plurality of second additional openings provided in the cylindrical body; wherein:

each second additional opening has a central axis and is sized and shaped to correspond with the peripheral front surface of the second additional loudspeaker, the central axes of the plurality of second additional openings are positioned in second additional radial planes, and angles between adjacent axes per radial plane are identical; and the plurality of second additional loudspeakers is disposed in the plurality of second additional openings and is hermetically secured to the cylindrical body, and the cylindrical body comprises dents in which at least one of the plurality of openings, the plurality of the first additional openings and the plurality of the second additional openings are disposed.

2. The loudspeaker assembly of claim 1, wherein the angles between adjacent axes in the first additional radial plane are shifted from the angles between adjacent axes in the radial plane by an offset angle.

3. The loudspeaker assembly of claim 2, wherein the offset angle is half of the angles between adjacent axes in the radial plane.

4. The loudspeaker assembly of claim 1, wherein at least one of the plurality of loudspeakers, the plurality of first additional loudspeakers and the plurality of second additional loudspeakers are broadband loudspeakers or mid-frequency range loudspeakers.

5. The loudspeaker assembly of claim 1, wherein the cylindrical body comprises a necking along a longitudinal direction, in which at least one of the plurality of openings, the plurality of first additional openings and the plurality of second additional openings are disposed.

6. The loudspeaker assembly of claim 5, wherein at least some of the plurality of second additional loudspeakers are high-frequency range loudspeakers, the high-frequency range loudspeakers being disposed in a middle of the necking.

7. The loudspeaker assembly of claim 6, wherein at least some of the plurality of second additional loudspeakers are low-frequency range loudspeakers, the low-frequency range loudspeakers being disposed at a margin or margins of the necking.

8. The loudspeaker assembly of claim 1, further comprising an electrical port providing connection to each individual loudspeaker of the plurality of loudspeaker.

9. The loudspeaker assembly of claim 1, wherein the hollow cylindrical body is configured to provide at least some of the loudspeakers of the plurality of loudspeakers an individual and hermetically sealed acoustic volume.

10. A higher-order loudspeaker system comprising a loudspeaker assembly according to claim 1, and a beamforming module.

11. The higher-order loudspeaker system of claim 10, wherein the beamforming module comprises a modal weighting module, a rotation module, and a regularization and matrixing module, and wherein the regularization and matrixing module including a weighting matrix or a multiple-input multiple-output filter matrix.

12. A loudspeaker assembly comprising:

a plurality of loudspeakers, each loudspeaker being substantially the same size and having a peripheral front surface; and an enclosure having a hollow cylindrical body and end closures, the cylindrical body and end closures being made of material that is impervious to air; wherein the cylindrical body comprises a plurality of openings therein;

each opening has a central axis and is shaped to correspond with the peripheral front surface of the loudspeaker, the central axes of the plurality of openings are contained in a radial plane; and each loudspeaker is disposed in the corresponding opening and is hermetically secured to the cylindrical body, the loudspeaker assembly further comprising:

a plurality of first additional loudspeakers, each first additional loudspeaker is substantially the same size as the loudspeaker of the plurality of loudspeakers and has a peripheral front surface; and a plurality of first additional openings provided in the cylindrical body; wherein each first additional opening has a central axis and is sized and shaped to correspond with the peripheral front surface of the first additional loudspeaker;

the central axes of the plurality of first additional openings are contained in a first additional radial plane, and angles between adjacent axes are identical; and the plurality of first additional loudspeakers is disposed in the plurality of first additional openings and is hermetically secured to the cylindrical body;

a plurality of second additional loudspeakers, each second additional loudspeaker having a peripheral front surface; and a plurality of second additional openings provided in the cylindrical body; wherein:

each second additional opening has a central axis and is sized and shaped to correspond with the peripheral front surface of the second additional loudspeaker, the central axes of the plurality of second additional openings are positioned in second additional radial planes, and angles between adjacent axes per radial plane are identical; and the plurality of second additional loudspeakers is disposed in the plurality of second additional openings and is hermetically secured to the cylindrical body, and the cylindrical body comprises dents in which at least one of the plurality of openings, the plurality of the first additional openings and the plurality of the second additional openings are disposed.

13. A loudspeaker assembly comprising:

a plurality of loudspeakers, each loudspeaker being substantially the same size and having a peripheral front surface; and an enclosure having a hollow cylindrical body and end closures; wherein the cylindrical body comprises a plurality of openings therein;

each opening has a central axis and is shaped to correspond with the peripheral front surface of the loudspeaker, the central axes of the plurality of openings are contained in a radial plane, and angles positioned between adjacent axes are identical; and each loudspeaker is disposed in the corresponding opening and is hermetically secured to the cylindrical body, the loudspeaker assembly further comprising:

a plurality of first additional loudspeakers, each first additional loudspeaker is substantially the same size as the loudspeaker of the plurality of loudspeakers and has a peripheral front surface; and a plurality of first additional openings provided in the cylindrical body; wherein each first additional opening has a central axis and is sized and shaped to correspond with the peripheral front surface of the first additional loudspeaker;

the central axes of the plurality of first additional openings are contained in a first additional radial plane, and angles between adjacent axes are identical; and the plurality of first additional loudspeakers is disposed in the plurality of first additional openings and is hermetically secured to the cylindrical body;

a plurality of second additional loudspeakers, each second additional loudspeaker having a peripheral front surface; and a plurality of second additional openings provided in the cylindrical body; wherein:

each second additional opening has a central axis and is sized and shaped to correspond with the peripheral front surface of the second additional loudspeaker, the central axes of the plurality of second additional openings are positioned in second additional radial planes, and angles between adjacent axes per radial plane are identical; and the plurality of second additional loudspeakers is disposed in the plurality of second additional openings and is hermetically secured to the cylindrical body, and the cylindrical body comprises dents in which at least one of the plurality of openings, the plurality of the first additional openings and the plurality of the second additional openings are disposed.

14. A loudspeaker assembly comprising:

a plurality of loudspeakers, each loudspeaker being substantially the same size and having a peripheral front surface; and an enclosure having a hollow cylindrical body and end closures, the cylindrical body and end closures being made of material that is impervious to air; wherein the cylindrical body comprises a plurality of openings therein;

each opening has a central axis and is shaped to correspond with the peripheral front surface of the loudspeaker, the central axes of the plurality of openings are contained in a radial plane, and angles positioned between adjacent axes are identical; and each loudspeaker is disposed in the corresponding opening and is hermetically secured to the cylindrical body, the loudspeaker assembly further comprising:

a plurality of first additional loudspeakers, each first additional loudspeaker is substantially the same size as the loudspeaker of the plurality of loudspeakers and has a peripheral front surface; and a plurality of first additional openings provided in the cylindrical body; wherein each first additional opening has a central axis and is sized and shaped to correspond with the peripheral front surface of the first additional loudspeaker;

the central axes of the plurality of first additional openings are contained in a first additional radial plane, and angles between adjacent axes are identical; and the plurality of first additional loudspeakers is disposed in the plurality of first additional openings and is hermetically secured to the cylindrical body;

a plurality of second additional loudspeakers, each second additional loudspeaker having a peripheral front surface; and a plurality of second additional openings provided in the cylindrical body; wherein:

each second additional opening has a central axis and is sized and shaped to correspond with the peripheral front surface of the second additional loudspeaker, the central axes of the plurality of second additional openings are positioned in second additional radial planes, and angles between adjacent axes per radial plane are identical; and the plurality of second additional loudspeakers is disposed in the plurality of second additional openings and is hermetically secured to the cylindrical body, and the cylindrical body comprises a necking along its a longitudinal direction, in which at least one of the L the plurality of openings, the L the plurality of first additional openings and the F the plurality of second additional openings are disposed.

15. A higher-order loudspeaker system comprising:

a loudspeaker assembly including:

a plurality of loudspeakers, each loudspeaker being substantially the same size and having a peripheral front surface; and an enclosure having a hollow cylindrical body and end closures, the cylindrical body and end closures being made of material that is impervious to air; wherein the cylindrical body comprises a plurality of openings therein;

each opening has a central axis and is shaped to correspond with the peripheral front surface of the loudspeaker, the central axes of the plurality of openings are contained in a radial plane, and angles positioned between adjacent axes are identical; and each loudspeaker is disposed in the corresponding opening and is hermetically secured to the cylindrical body, and a beamforming module that comprises a modal weighting module, a rotation module, and a regularization and matrixing module, wherein the regularization and matrixing module includes a weighting matrix or a multiple-input multiple-output filter matrix.

* * * * *